US006842676B2

(12) United States Patent
Rodriguez

(10) Patent No.: US 6,842,676 B2
(45) Date of Patent: Jan. 11, 2005

(54) METHOD FOR UPDATING AN ELECTRONIC SERVICE TOOL

(75) Inventor: Rogelio Rodriguez, Berwyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 11 days.

(21) Appl. No.: 10/384,964

(22) Filed: Mar. 10, 2003

(65) Prior Publication Data

US 2004/0181325 A1 Sep. 16, 2004

(51) Int. Cl.[7] ..... F02D 45/00

(52) U.S. Cl. ..... 701/29; 701/30; 701/36; 702/182; 702/184

(58) Field of Search ..... 701/29, 35, 36, 701/52, 102, 30, 33; 702/119, 187, 182, 184; 700/113; 709/203; 73/117.3

(56) References Cited

U.S. PATENT DOCUMENTS 5,463,567 A * 10/1995 Boen et al. ..... 702/187
5,999,876 A * 12/1999 Irons et al. ..... 701/115
6,181,992 B1 * 1/2001 Gurne et al. ..... 701/29
6,601,442 B1 * 8/2003 Decker et al. ..... 73/117.3

* cited by examiner

*Primary Examiner*—Thomas G. Black
*Assistant Examiner*—Arthur D. Donnelly
(74) *Attorney, Agent, or Firm*—Dennis Kelly Sullivan; Susan L. Lukasik; Jeffrey P. Calfa

(57) ABSTRACT

A method for servicing a motor vehicle (10) with an electronic service tool (14) that is placed in bi-directional data communication with an electrical system in the vehicle. With the vehicle's motor not running, but with electric power being applied to the vehicle's electrical system, tool (14) is updated by transmitting from the vehicle to the tool, set data containing a current set of vehicle-related parameters stored in the vehicle. With the motor running, the vehicle is serviced with the tool using the set data transmitted to update the tool.

5 Claims, 1 Drawing Sheet

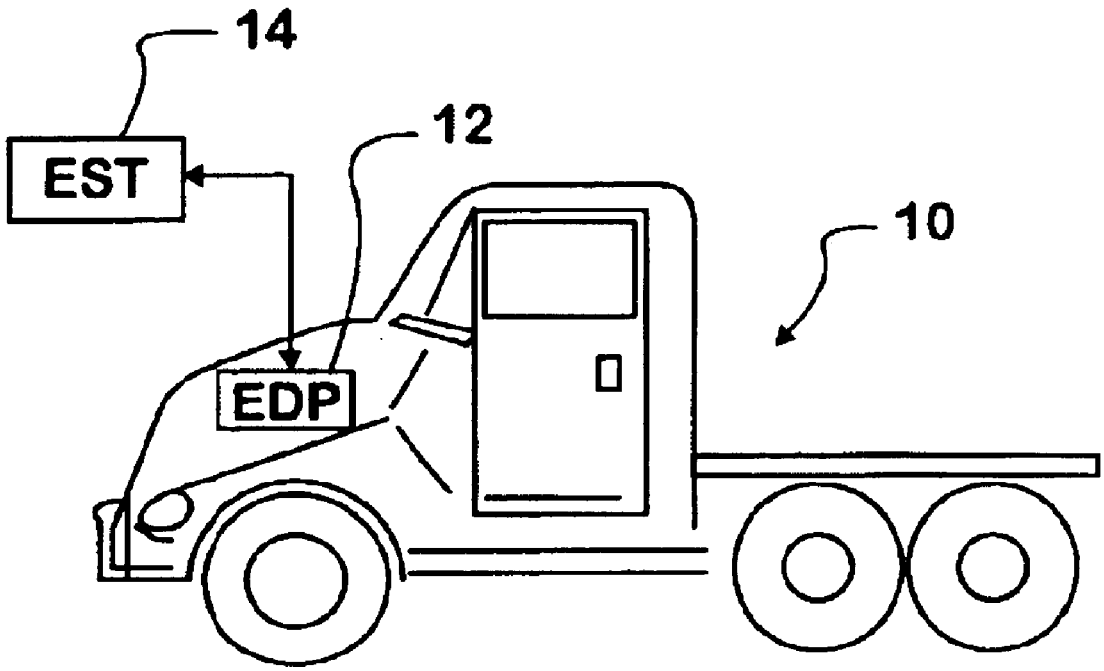

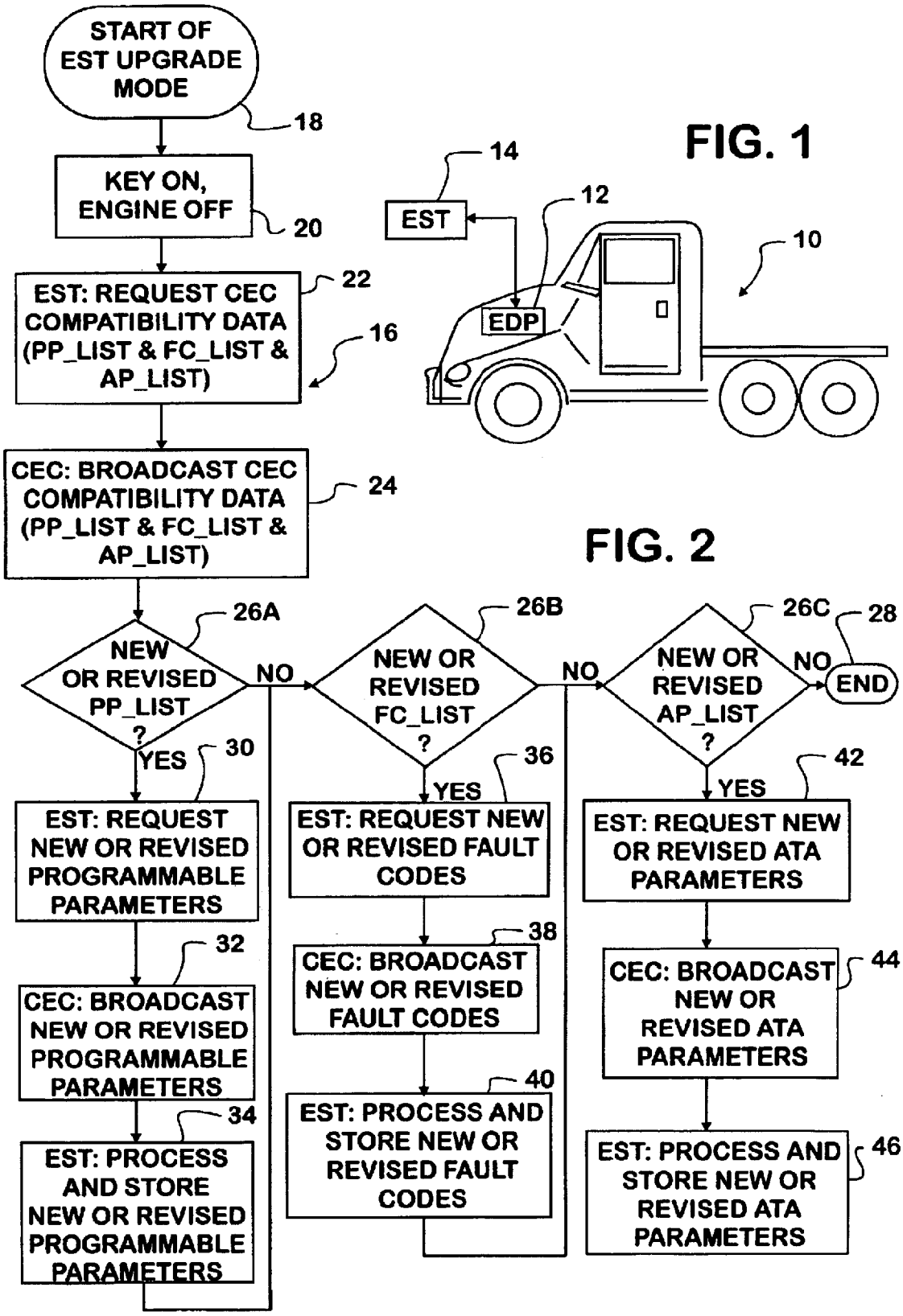
START OF EST UPGRADE MODE
18
KEY ON, ENGINE OFF
20
EST: REQUEST CEC COMPATIBILITY DATA (PP_LIST & FC_LIST & AP_LIST)
22
16
CEC: BROADCAST CEC COMPATIBILITY DATA (PP_LIST & FC_LIST & AP_LIST)
24
14
EST
12
EDP
10
FIG. 1
FIG. 2
26A
NEW OR REVISED PP_LIST ?
NO
YES
30
EST: REQUEST NEW OR REVISED PROGRAMMABLE PARAMETERS
32
CEC: BROADCAST NEW OR REVISED PROGRAMMABLE PARAMETERS
34
EST: PROCESS AND STORE NEW OR REVISED PROGRAMMABLE PARAMETERS
26B
NEW OR REVISED FC_LIST ?
NO
YES
36
EST: REQUEST NEW OR REVISED FAULT CODES
38
CEC: BROADCAST NEW OR REVISED FAULT CODES
40
EST: PROCESS AND STORE NEW OR REVISED FAULT CODES
26C
NEW OR REVISED AP_LIST ?
NO
28
END
YES
42
EST: REQUEST NEW OR REVISED ATA PARAMETERS
44
CEC: BROADCAST NEW OR REVISED ATA PARAMETERS
46
EST: PROCESS AND STORE NEW OR REVISED ATA PARAMETERS

METHOD FOR UPDATING AN ELECTRONIC SERVICE TOOL

FIELD OF THE INVENTION

This invention relates to the servicing of motor vehicles that have electrical systems containing data processors that electronically process data and use the processing results in certain aspects of vehicle operation, such engine control.

BACKGROUND OF THE INVENTION

Motor vehicles require periodic servicing, and some of that servicing involves the use of electrical equipment that is connected to a vehicle's electrical system at a service facility. Various pieces of electrical equipment may be used, and one piece of equipment is sometimes referred to as an electronic service tool, or EST for short.

An EST contains a data processing system that processes certain data according to certain algorithms for evaluating the operation of a vehicle and/or operation of various components of the vehicle. Such operation may be current or historic. For example, certain industry standards define certain fault codes for various components and/or operation of vehicle components. An EST can interrogate a vehicle's electrical system to ascertain if any fault flags have, either at present or in the past, been set for the various fault codes.

An EST can therefore serve as a diagnostic aid for identifying potentially non-compliant components and/or operation, and hence, aid servicing personnel in properly servicing a motor vehicle.

For properly evaluating any particular vehicle, an EST must itself contain proper background data relating to the particular vehicle. A vehicle whose electrical system comprises one or more electrical data processing systems, an example of one such system being an electronic engine control system, stores certain data that is particular to that vehicle. Each item of data characterizes a specific component in the vehicle or a specific operation performed in the vehicle.

Certain industry standards, such as ATA (American Trucking Association) standards, define certain items of interest for certain vehicle components and certain specific operations. Other items of interest include fault codes for identifying particular faults that may be occurring at present, or may have occurred in the past, and programmable parameters that are specified by a vehicle manufacturer for the particular vehicle. Some examples of the foregoing items are: engine speed, engine oil pressure, engine oil temperature out of range high, and cruise control vehicle speed high limit.

Diagnostic equipment such as an EST is typically purchased or leased by a service facility, such as a motor vehicle dealer or repair facility. It may represent a significant capital investment. Accordingly, it often desirable for a particular piece of equipment to be capable of servicing as large a universe of vehicles as possible. Because new vehicle models are periodically introduced by vehicle manufacturers, an EST that has already been in service may be unable to service the new models.

It has heretofore been necessary for service facilities to procure new EST's for servicing new vehicle models, or to update their existing ones. In either instance, the vehicle manufacturer is the original source for either new update information and/or new equipment specifications. One known way of updating a piece of service equipment such as an EST is for a vehicle manufacturer to specify that the piece of equipment have a replaceable a cartridge that can be removed and replaced from time to time by an updated cartridge containing new items of information for its vehicles, either additional to existing items, or in replacement of certain existing items.

One can therefore appreciate that a vehicle manufacturer must devote significant resources to enable service equipment in the field to handle all of its vehicles. Accordingly, procedures that accomplish that objective and that are less burdensome on resources, both manufacturers' and servicing facilities', are believed beneficial to improving organizational efficiencies and cost-effectiveness.

SUMMARY OF THE INVENTION

Accordingly, the present invention relates to a new method for accomplishing those objectives. Briefly, the present invention relies upon a new vehicle itself to furnish certain information for updating an existing piece of service equipment such as an EST. At time of service, information is exchanged between a vehicle and an EST. If the EST is found to lack certain information for proper servicing of the particular vehicle, data for the missing information is transmitted from the vehicle to the EST and stored in the EST. The stored data is then used during service evaluation of the vehicle by the EST. Examples of such data include a) programmable parameters, b) fault codes, and c) industry standard parameters.

One generic aspect of the present invention relates to a method for updating an EST that has an electronic data processing (EDP) system which is placed in bi-directional data communication with an EDP system in an electrical system of a motor vehicle when the vehicle is being serviced. With the vehicle motor not running, but with electric power being applied to the vehicle's EDP system, a compatibility request is transmitted from the EST's EDP system to the vehicle's EDP system to solicit a return of data identifying a current set of vehicle-related parameters stored in the vehicle's EDP system.

The EST's EDP system processes the returned data and data identifying each of one or more sets of vehicle-related parameters stored in the EST's EDP system to distinguish a match of the identity of the set of vehicle-related parameters stored in the vehicle's EDP system with that of any of the sets of vehicle-related parameters stored in the EST's EDP system from a non-match.

After a non-match has been disclosed, the EST transmits an update request to the vehicle to solicit a return of set data containing the current set of vehicle-related parameters stored in the vehicle's EDP system. That data is then stored in the EST's EDP system as another set of vehicle-related parameters.

Those parameters are subsequently used by the EST to evaluate the vehicle.

Another generic aspect of the invention relates to a method for servicing a motor vehicle with an EST that has an electronic data processing (EDP) system placed in bi-directional data communication with an EDP system in an electrical system of the motor vehicle. The method comprises: a) with the vehicle's motor not running, but with electric power being applied to the vehicle's EDP system, updating the EST by transmitting, from the vehicle's EDP system to the EST's EDP system, set data containing a current set of vehicle-related parameters stored in the vehicle's EDP system; and b) with the motor running, servicing the vehicle with the EST using the set data transmitted by step a).

The foregoing, along with further features and advantages of the invention, will be seen in the following disclosure of a presently preferred embodiment of the invention depicting the best mode contemplated at this time for carrying out the invention. This specification includes drawings, now briefly described as follows.

BRIEF DESCRIPTION OF THE DRAWINGS

FIG. 1 is a schematic diagram illustrating practice of the invention when a motor vehicle is being serviced by an electronic service tool.

FIG. 2 is a schematic block diagram of various steps of an exemplary method for practice of the invention.

DESCRIPTION OF THE PREFERRED EMBODIMENT

FIG. 1 shows an exemplary motor vehicle 10, a truck for example, comprising an electrical system that includes an electronic data processing (EDP) system 12, the particular example here being an engine, or motor, control system that controls an internal combustion engine that powers the vehicle. System 12 processes data from various sources according to various stored algorithms to develop various control data for controlling various aspects of engine operation. The data processed by system 12 may originate at external sources, such as sensors on the engine and vehicle, and/or be generated internally. Some data is externally programmed into memory of system 12 as programmable parameters, one example of which is "cruise control vehicle speed high limit". Other data is programmed into memory of system 12 in accordance with certain industry standards, an example of which is ATA (American Trucking Association) standards.

System 12 also has a capability for logging certain faults that may occur during vehicle operation. OBDII is a common requirement for logging certain types of faults, particularly in the engine and in emission control devices in the vehicle. The faults are logged in system 12 under certain defined fault codes.

When vehicle 10 is serviced, a piece of service equipment, such as an EST 14, is associated with system 12 so that electronic data can be exchanged between them. EST 14 comprises its own EDP system that is placed in bi-directional data communication with EDP system 12. Such communication may take place by wire, by wireless, or by a combination of both.

FIG. 2 discloses steps of an exemplary method 16 in accordance with principles of the invention. Step 18 is an initial step that is followed by a step 20 that checks to make sure that the engine of vehicle 10 is not running, but that electrical power to system 12 is on.

A step 22 then transmits a compatibility request from the EDP system of EST 14 to EDP system 12 in vehicle 10 to solicit a return of data from system 12 to EST 14 identifying one or more current sets of vehicle-related parameters stored in system 12. A step 24 represents the data return.

Steps 26A, 26B, and 26C represent the EDP system of EST 14 then processing the returned data for each such set and data identifying each of one or more corresponding sets of vehicle-related parameters stored in the EDP system of EST 14 to distinguish a match of the identity of each set of vehicle-related parameters stored in system 12 with that of any of the corresponding sets of vehicle-related parameters stored in EST 14 from a non-match.

In the example given here, a first set PP_LIST of vehicle-related parameters comprises programmable parameters; a second set FC_LIST, fault codes; and a third set AP_LIST, ATA parameters. If step 26A discloses a match, there is no need to update the programmable parameter set PP_LIST already stored in EST 14, in which case step 26B occurs. If step 26B discloses a match, there is no need to update the fault code sets PC_LIST already stored in EST 14, in which case step 26C occurs. If step 26C discloses a match, there is no need to update the ATA parameter sets AP_LIST already stored in EST 14, in which case the methods ends by represented by step 28.

If step 26A however discloses no match, then EST 14 is updated with a new set of programmable parameters corresponding to the set stored in system 12 in vehicle 10. A step 30 comprises transmitting an update request from EST 14 to system 12 to solicit a return of set data containing the current set of programmable parameters stored in system 12. That step is followed by a step 32 comprising system 12 transmitting to EST 14 the set data containing the current set of programmable parameters stored in system 12. Finally EST 14 performs a step 34 of processing and storing the set of programmable parameters that it just received from vehicle 10. Once that is complete, step 26B occurs.

If step 26B discloses no match, then EST 14 is updated with a new set of fault codes corresponding to the set stored in system 12 in vehicle 10. A step 36 comprises transmitting an update request from EST 14 to system 12 to solicit a return of set data containing the current set of fault codes stored in system 12. That step is followed by a step 38 comprising system 12 transmitting to EST 14 the set data containing the current set of fault codes stored in system 12. Finally EST 14 performs a step 40 of processing and storing the set of fault codes that it just received from vehicle 10. Once that is complete, step 26C occurs.

If step 26C discloses no match, then EST 14 is updated with a new set of ATA parameters corresponding to the set stored in system 12 in vehicle 10. A step 42 comprises transmitting an update request from EST 14 to system 12 to solicit a return of set data containing the current set of ATA parameters stored in system 12. That step is followed by a step 44 comprising system 12 transmitting to EST 14 the set data containing the current set of ATA parameters stored in system 12. Finally EST 14 performs a step 46 of processing and storing the set of ATA parameter codes that it just received from vehicle 10. Once that is complete, the method ends at step 28.

It should be under stood that updating may comprise either adding a complete new set of the relevant parameters in EST 14 as an additional stored set or selectively updating individual items in an existing set.

Assuming that EST 14 has been updated by method 16, the motor is then started and with the motor running, the vehicle is serviced with EST 14 using the updated data.

While a presently preferred embodiment of the invention has been illustrated and described, it should be appreciated that principles of the invention apply to all embodiments falling within the scope of the following claims.

What is claimed is:

1. A method for updating an electronic service tool (EST) that has an electronic data processing (EDP) system which is placed in bi-directional data communication with an EDP system in an electrical system of a motor vehicle when the vehicle is being serviced, the method comprising:

with the vehicle motor not running, but with electric power being applied to the vehicle's EDP system, a) transmitting a compatibility request from the EST's EDP system to the vehicle's EDP system to solicit a return of data from the vehicle's EDP system to the EST's EDP system identifying a current set of vehicle-related parameters stored in the vehicle's EDP system;

b) processing, in the EST's EDP system, the data returned from the vehicle's EDP system to the EST's EDP system in response to the compatibility request and data identifying each of one or more sets of vehicle-related parameters stored in the EST's EDP system to distinguish a match of the identity of the set of vehicle-related parameters stored in the vehicle's EDP system with that of any of the sets of vehicle-related parameters stored in the EST's EDP system from a non-match;

c) after step b) has disclosed a non-match, transmitting an update request from the EST's EDP system to the vehicle's EDP system to solicit a return of set data containing the current set of vehicle-related parameters stored in the vehicle's EDP system; and d) then storing, in the EST's EDP system, the set data returned from the vehicle's EDP system as another set of vehicle-related parameters.

2. A method as set forth in claim 1 wherein:

step a) comprises transmitting a compatibility request that solicits a return of data identifying a current set of programmable parameters stored in the vehicle's EDP system;

step b) comprises processing, in the EST's EDP system, the returned data identifying a current set of programmable parameters stored in the vehicle's EDP system and data identifying each of one or more sets of programmable parameters stored in the EST's EDP system to distinguish a match of the identity of the current set of programmable parameters stored in the vehicle's EDP system with the identity of any of the sets of programmable parameters stored in the EST's EDP system from a non-match;

step c) comprises, after step b) has disclosed a non-match, transmitting an update request from the EST's EDP system to the vehicle's EDP system to solicit a return of data containing a current set of programmable parameters stored in the vehicle's EDP system; and step d) comprises then storing, in the EST's EDP system, the returned data containing a current set of programmable parameters.

3. A method as set forth in claim 1 wherein:

step a) comprises transmitting a compatibility request that solicits a return of data identifying a current set of fault codes stored in the vehicle's EDP system;

step b) comprises processing, in the EST's EDP system, the returned data identifying a current set of fault codes stored in the vehicle's EDP system and data identifying each of one or more sets of fault codes stored in the EST's EDP system to distinguish a match of the identity of the current set of fault codes stored in the vehicle's EDP system with the identity of any of the sets of fault codes stored in the EST's EDP system from a non-match;

step c) comprises, after step b) has disclosed a non-match, transmitting an update request from the EST's EDP system to the vehicle's EDP system to solicit a return of data containing a current set of fault codes stored in the vehicle's EDP system; and step d) comprises then storing, in the EST's EDP system, the returned data containing a current set of fault codes.

4. A method as set forth in claim 1 wherein:

step a) comprises transmitting a compatibility request that solicits a return of data identifying a current set of industry standard parameters stored in the vehicle's EDP system;

step b) comprises processing, in the EST's EDP system, the returned data identifying a current set of industry standard parameters stored in the vehicle's EDP system and data identifying each of one or more sets of industry standard parameters stored in the EST's EDP system to distinguish a match of the identity of the current set of industry standard parameters stored in the vehicle's EDP system with the identity of any of the sets of industry standard parameters stored in the EST's EDP system from a non-match;

step c) comprises, after step b) has disclosed a non-match, transmitting an update request from the EST's EDP system to the vehicle's EDP system to solicit a return of data containing a current set of industry standard parameters stored in the vehicle's EDP system; and step d) comprises then storing, in the EST's EDP system, the returned data containing a current set of industry standard parameters.

5. A method as set forth in claim 1 further including the further steps of:

e) running the vehicle's motor; and f) with the motor running, servicing the vehicle with the EST using the data stored in the EST's EDP system by step d).

* * * * *